US010037856B2

(12) United States Patent
Maloney et al.

(10) Patent No.: US 10,037,856 B2
(45) Date of Patent: Jul. 31, 2018

(54) ELECTRICAL SYSTEM, AND ELECTRICAL SWITCHING APPARATUS AND GUARD MEMBER THEREFOR

(71) Applicant: EATON CORPORATION, Cleveland, OH (US)

(72) Inventors: James Gerard Maloney, Industry, PA (US); Alexis Rodriguez Rodriguez, Santo Domingo (DO); Luis Enrique Betances Sansur, Santo Domingo (DO)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/273,813

(22) Filed: Sep. 23, 2016

(65) Prior Publication Data

US 2018/0090285 A1 Mar. 29, 2018

(51) Int. Cl.
*H01H 9/02* (2006.01)
*H01H 13/04* (2006.01)

(52) U.S. Cl.
CPC ..... *H01H 9/0264* (2013.01); *H01H 2223/044* (2013.01)

(58) Field of Classification Search
CPC ..... H01H 9/0264; H01H 2223/044; H01R 13/447
USPC ..... 200/304; 335/202; 218/77, 155; 439/113, 136–139, 144, 367, 521, 528, 439/892
See application file for complete search history.

(56) References Cited

U.S. PATENT DOCUMENTS

| | | | | |
|---|---|---|---|---|
| 5,150,091 | A | 9/1992 | Hart et al. | |
| 5,493,092 | A | 2/1996 | Rowe | |
| 5,933,066 | A | 8/1999 | Chontas et al. | |
| 6,942,527 | B1 * | 9/2005 | Lias | H01H 11/0031 335/202 |
| 7,798,868 | B2 * | 9/2010 | Borona | H01R 4/305 335/202 |
| 9,548,170 | B2 * | 1/2017 | Crooks | H01H 9/0264 |
| 2014/0151201 | A1 | 6/2014 | Sisley et al. | |

* cited by examiner

*Primary Examiner* — Edwin A. Leon
*Assistant Examiner* — Lheiren Mae A Caroc
(74) *Attorney, Agent, or Firm* — Eckert Seamans

(57) ABSTRACT

A guard member is for an electrical switching apparatus of an electrical system. The electrical system includes at least one electrical conductor. The electrical switching apparatus has a housing. The guard member includes a base portion structured to receive the electrical conductor, a number of coupling portions extending from the base portion and being structured to be coupled to the housing, and a plurality of petal portions extending from the base portion away from the number of coupling portions. At least one of the petal portions is orientated at an acute angle with respect to the base portion.

18 Claims, 4 Drawing Sheets

ELECTRICAL SYSTEM, AND ELECTRICAL SWITCHING APPARATUS AND GUARD MEMBER THEREFOR

CROSS-REFERENCE TO RELATED APPLICATION

This application is related to commonly assigned U.S. patent application Ser. No. 15/152,661, filed May 12, 2016.

BACKGROUND

Field

The disclosed concept relates to electrical systems. The disclosed concept further relates to electrical switching apparatus, such as, for example, circuit breakers for electrical systems. The disclosed concept also relates to guard members for electrical switching apparatus.

Background Information

Electrical systems commonly include electrical conductors (e.g., without limitation, wires or cables) that couple to electrical apparatus, such as electrical switching apparatus. Electrical switching apparatus are used to protect electrical circuitry from damage due to a trip condition, such as, for example, an overcurrent condition, an overload condition, an undervoltage condition, a relatively high level short circuit or fault condition, a ground fault or arc fault condition. Circuit breakers, for example, commonly include wiring terminals as a means to attach the electrical conductors. While the wires are generally insulated, the end that attaches to the circuit breaker wiring terminal has the insulation removed (i.e., stripped).

It is common that the stripped portion of these wires extends to some degree outside the circuit breaker wiring terminal, such that, when a person is exposed to the circuit breaker and associated wiring, the person is also exposed to some portion of the uninsulated wires, and possibly also the uninsulated portion of the circuit breaker wiring terminal. This exposure to uninsulated electrically energized conductors (wires and/or wiring terminals) allows for the possibility of inadvertent contact by a person, tool, or the like, while performing various types of service or maintenance activities. Additionally, in order to be properly certified, for example and without limitation, by Underwriters Laboratories Inc. (UL), headquartered in Northbrook, Ill., some circuit breakers are required to have no live components accessible when the circuit breaker is turned off.

There is, therefore, room for improvement in electrical systems, and in electrical switching apparatus and guard members therefor.

SUMMARY

These needs and others are met by embodiments of the disclosed concept, which are directed to an electrical system, and electrical switching apparatus and guard member therefor.

As one aspect of the disclosed concept, a guard member is provided for an electrical switching apparatus of an electrical system. The electrical system includes at least one electrical conductor. The electrical switching apparatus has a housing. The guard member includes a base portion structured to receive the electrical conductor, a number of coupling portions extending from the base portion and being structured to be coupled to the housing, and a plurality of petal portions extending from the base portion away from the number of coupling portions. At least one of the petal portions is orientated at an acute angle with respect to the base portion.

As another aspect of the disclosed concept, an electrical system and an electrical switching apparatus including the aforementioned guard member are provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the term "electrical conductor" refers to any suitable electrically conductive element, expressly including, but not being limited to, cables or wires.

Figure 1:
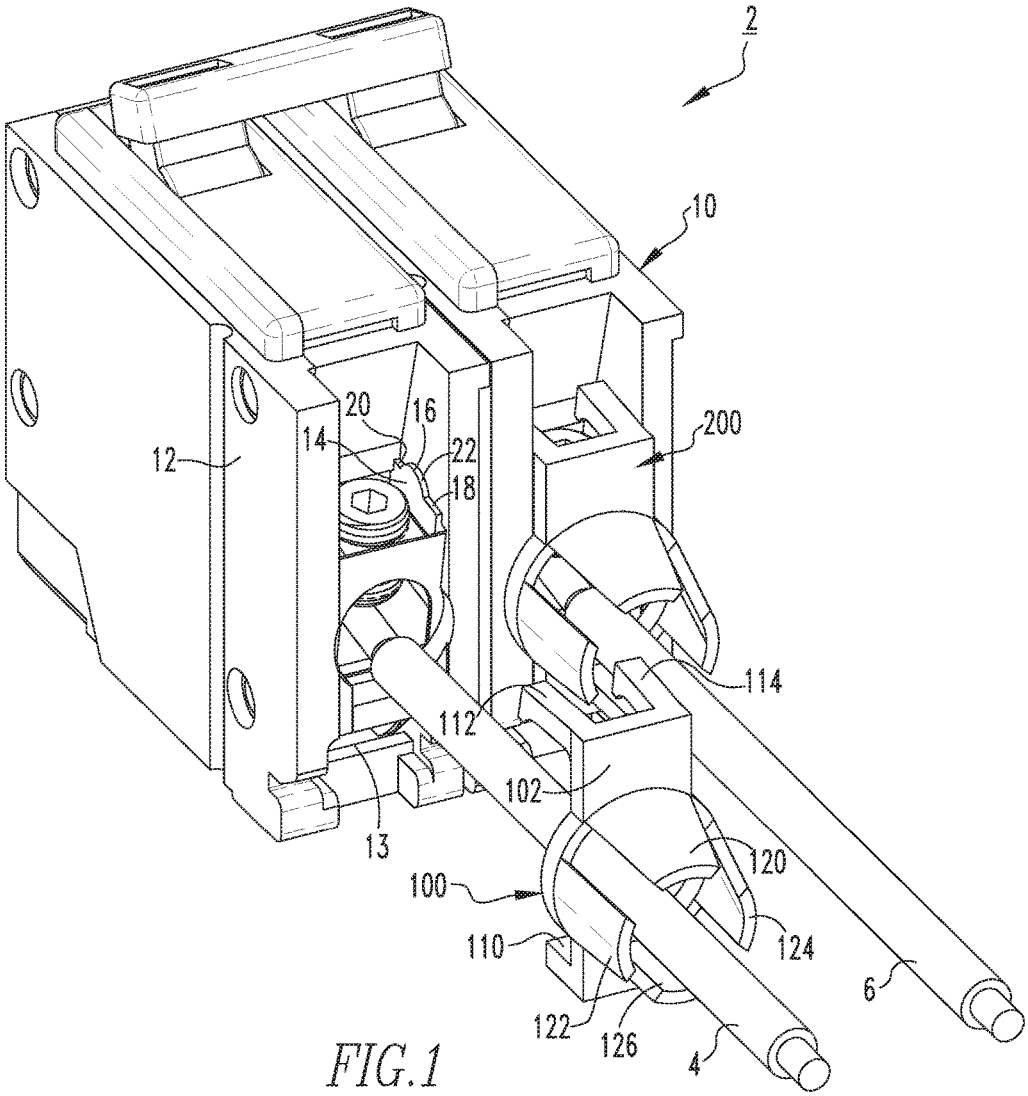
FIG. 1 is an exploded isometric view of an electrical system, and electrical switching apparatus and guard member therefor, in accordance with a non-limiting embodiment of the disclosed concept.

FIG. 1 shows an electrical system 2, in accordance with a non-limiting embodiment of the disclosed concept. The example electrical system 2 includes an electrical switching apparatus (e.g., without limitation, multi-pole circuit breaker 10) and a number of electrical conductors 4,6 mechanically coupled and electrically connected to the circuit breaker 10. The circuit breaker 10 has a housing 12 and a number of novel guard members 100,200 structured to be coupled to the housing 12 (guard member 100 is shown prior to being coupled to the housing 12, whereas guard member 200 is shown coupled to the housing 12, in FIG. 1). As will be discussed in greater detail below, among other benefits, the guard members 100,200 protect operators against unintended and potentially dangerous contact with live energized components of the electrical system 2, allow for venting of exhaustive gases and heat dissipation, and advantageously allow the circuit breaker 10 to pass UL certification requirements.

Figure 2:
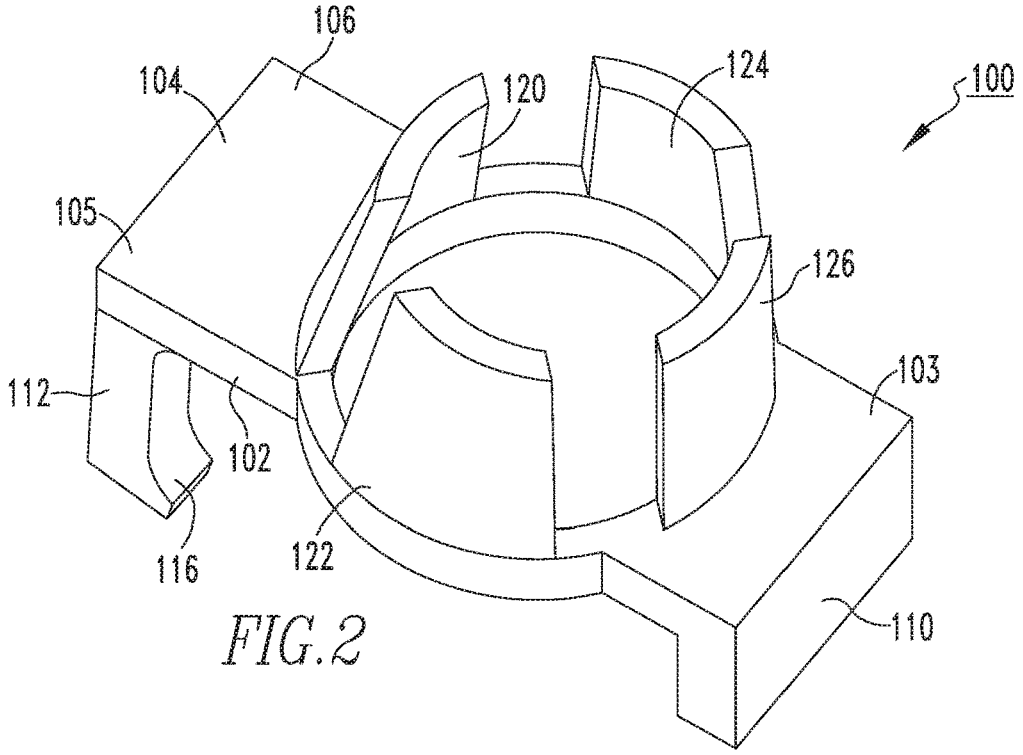
FIGS. 2 and 3 are isometric views of a guard member for the electrical system of FIG. 1.
Figure 3:
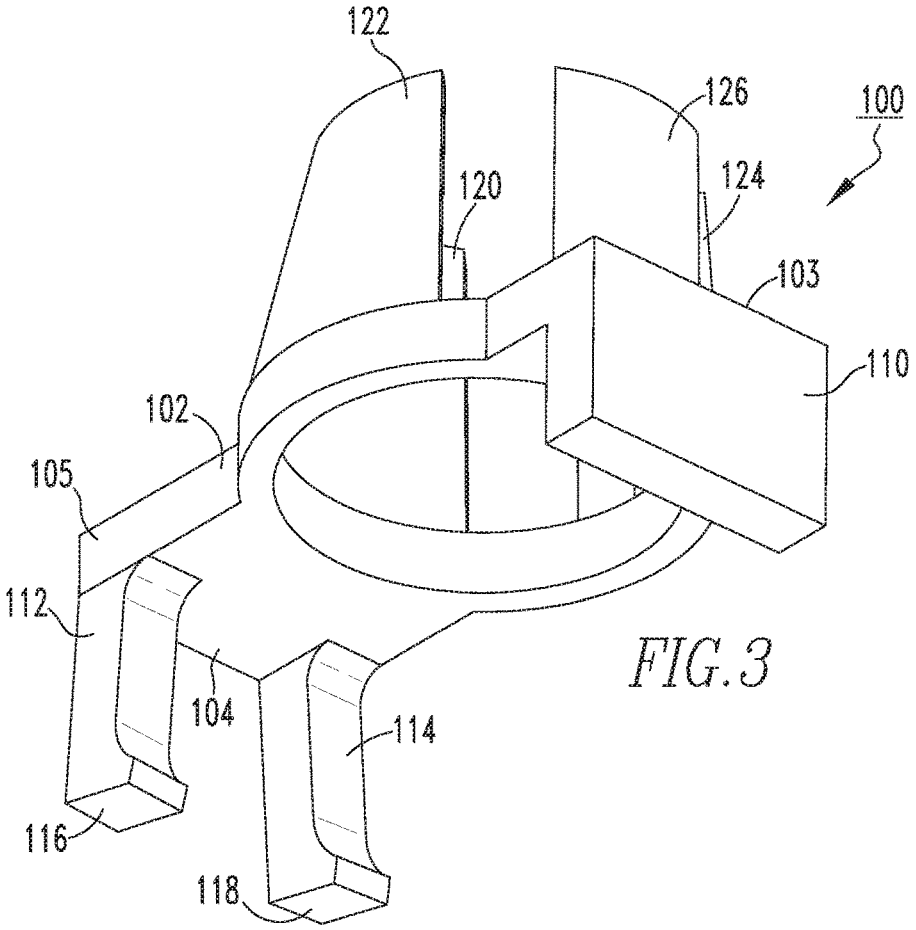

For economy of disclosure, only the guard member 100 will be described in detail, although it will be appreciated that the guard member 200 in the example of FIG. 1 is preferably substantially the same as the guard member 100. As seen in FIG. 2 and FIG. 3, the guard member 100 has a generally planar base portion 102, a number of coupling portions 110, 112, 114 extending from the base portion 102, and a plurality of petal portions 120, 122, 124, 126 extending from the base portion 102 away from the coupling portions 110, 112, 114. As will be discussed below, the geometry of the guard member 100 advantageously allows it to be securely maintained on the circuit breaker 10, and also allows exhaustive gases to be vented and heat to be dissipated during current interruption.

The base portion 102 has opposing end portions 103,104 and the petal portions 120, 122, 124, 126 are between the end portions 103,104. The coupling portion 110 extends from the end portion 103 and the coupling portions 112,114 extend from respective distal portions 105,106 of the end portion 104 in directions perpendicular to the base portion 102. Furthermore, the guard member 100 is coupled to the housing 12 by a snap-fit mechanism.

More specifically, the housing 12 includes a number of shelf portions (one example shelf portion 14 is shown in FIG. 1) that allow for the snap-fit connection. During assembly, the coupling portion 110 is inserted into the housing 12, and the coupling portions 112,114 flex over the shelf portions (i.e., the shelf portion 14 and a second opposing shelf portion (not shown) for the coupling portion 112) and snap into place. That is, the shelf portion 14 has an edge portion 16 having planar portions 18,20 and a protruding portion 22 extending between the planar portions 18,20. As seen, while the coupling portion 110 is generally planar, the coupling portions 112,114 each have respective hook portions 116,118 (see, for example, FIG. 3) located opposite and distal the base portion 102. The hook portions 116,118 snap over and engage the respective protruding portions 22 such that the protruding portions 22 are located between the respective hook portions 116,118 and the base portion 102. This allows for a relatively secure connection. Additionally, the guard members 100,200 are preferably made of a relatively hard thermoplastic material that makes them difficult to dislodge. As a result, during UL performance testing, the guard members 100,200 remain coupled to (i.e., are not blown off from) the circuit breaker 10 when current is interrupted at levels of around 65,000 amperes.

Figure 4:
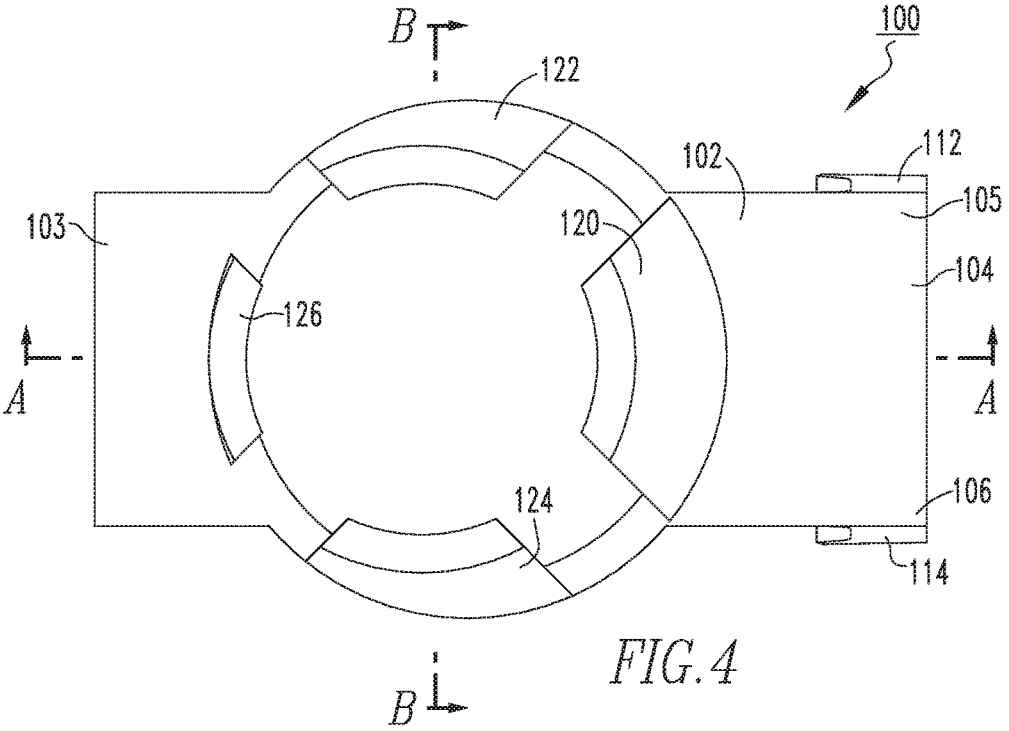
FIG. 4 is a top plan view of the guard member of FIGS. 2 and 3.

The petal portions 120, 122, 124, 126 provide a novel mechanism to protect operators from inadvertent contact with potentially live portions of the electrical system 2 (e.g., without limitation, terminals of the circuit breaker 10 and/or uninsulated portions of the electrical conductors 4,6) to allow the circuit breaker 10 to pass UL certification tests, and further are configured to deflect in order to allow the electrical conductors 4,6 to be bent when desired. As shown in FIG. 4, the base portion 102 has a thru hole that is configured to receive the electrical conductor 4 (FIG. 1). The petal portions 120, 122, 124, 126 each surround the thru hole. In this manner, the petal portions 120, 122, 124, 126 function as a barrier between operators/external objects (e.g., without limitation, a straight probe during UL certification testing) and any live components of the electrical system 2 (FIG. 1).

Figure 5:
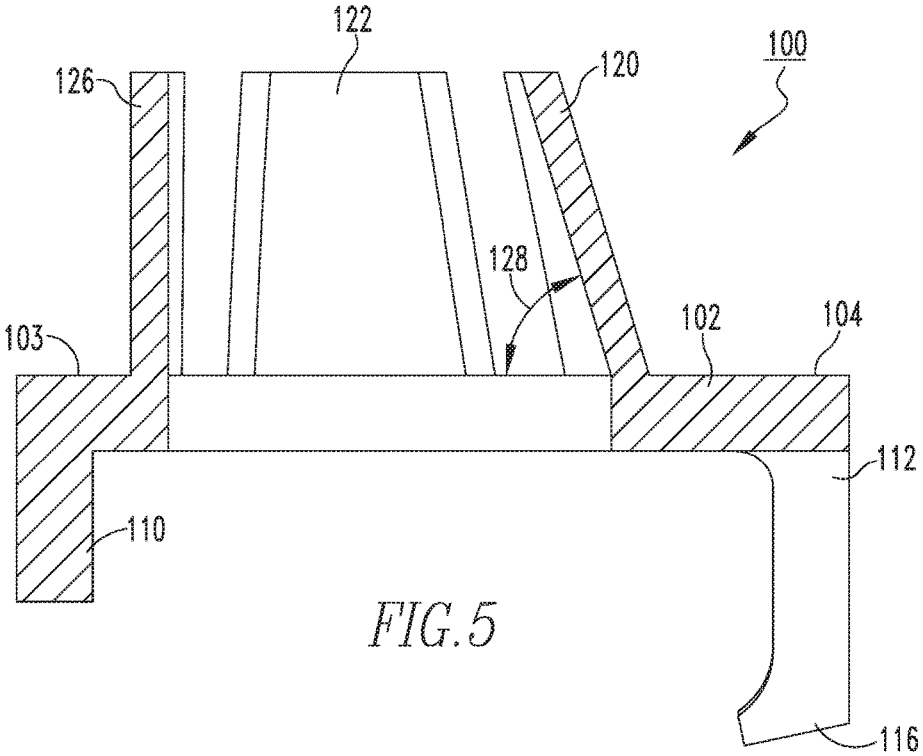
FIG. 5 is a section view of the guard member of FIG. 4, taken along line A-A of FIG. 4.
Figure 6:
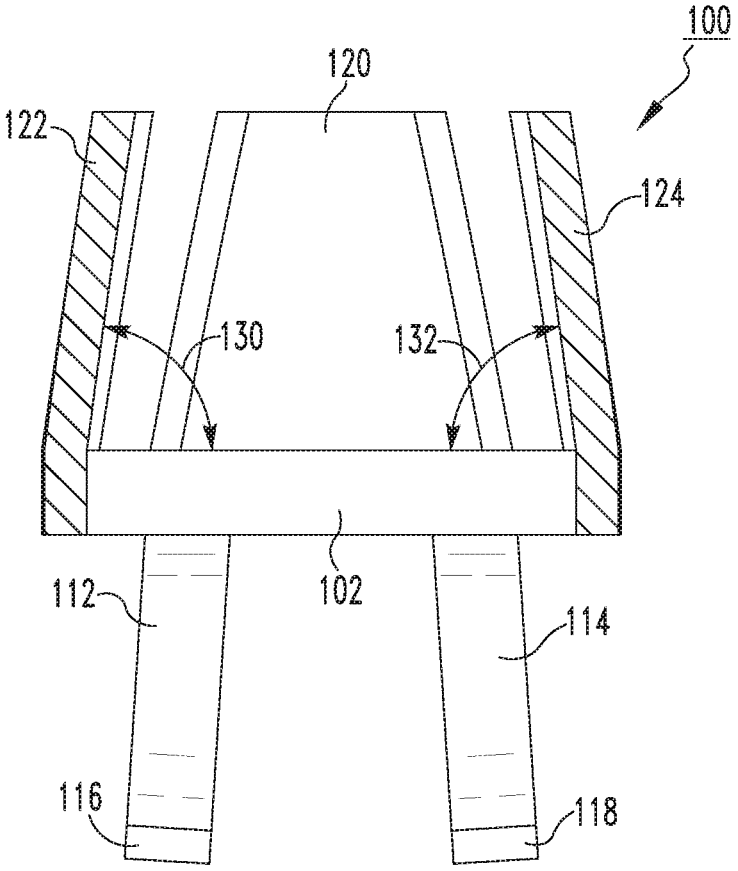
FIG. 6 is another section view of the guard member of FIG. 4, taken along line B-B of FIG. 4.

It will be appreciated that at least one of the petal portions 120, 122, 124 is at an acute angle with respect to the base portion 102 in order to prevent entry into an interior of the electrical system 2 by operators and/or external objects. In other words, with respect to the interior of the base portion 102 proximate the thru hole (i.e., the thru hole that receives the electrical conductor 4), the petal portions 120, 122, 124 are at acute angles. As shown in FIG. 5, the petal portion 126 is oriented generally perpendicular with respect to the base portion 102. The reason is because when the electrical conductor 4 (FIG. 1) is coupled to the circuit breaker 10, the electrical conductor 4 is configured to be oriented generally horizontal, or perpendicular with respect to the base portion 102. However, in order to provide a barrier between operators/external objects and any live components of the electrical system 2, the petal portions 120, 122, 124 are each oriented at respective acute angles 128 (shown in FIG. 5), 130 (shown in FIG. 6), 132 (shown in FIG. 6) with respect to the base portion 102. That is, with respect to a top plane of the base portion 102 proximate the thru hole (i.e., the interior of the base portion 102 that receives the electrical conductor 4), the angles 128, 130, 132 are all acute. Stated differently, when the electrical system 2 is assembled and the electrical conductor 4 is oriented perpendicular with respect to the base portion 102, as shown in FIG. 1, the petal portions 120, 122, 124 each extend from the base portion 102 toward the electrical conductor 4. Accordingly, fingers from an operator or straight probes during UL testing, for example, will be obstructed from contacting any live components of the electrical system 2.

Additionally, the acute angle 128 (FIG. 5) of the petal portion 120 is greater than the acute angles 130,132 (FIG. 6) of the respective petal portions 122,124. This is because the electrical system 2 (FIG. 1) is often installed into operating conditions wherein the electrical conductors 4,6 (FIG. 1) are bent (i.e., bent at 90 degree angles proximate the petal portions 122,124. Accordingly, the nature of the acute angles 130,132 (FIG. 6) of the petal portions 122,124 relative to the acute angle 128 (FIG. 5) of the petal portion 120 allows for the electrical conductor 4 (FIG. 1) to be bent, when desired, without the petal portions 122,124 significantly cutting into the electrical conductor 4 (FIG. 1). For example, as shown in FIG. 1, there is a relatively large amount of radial spacing between the electrical conductor 4 and the petal portions 122,124, thereby providing clearance for the electrical conductor 4 to be bent toward either one of the petal portions 122,124.

During UL short circuit testing, significant heat and exhaustive gases are given off by the circuit breaker 10. However, the geometry of the guard members 100,200 advantageously ensures that the heat and exhaustive gases are able to be reliably vented, thereby reducing internal heat buildup in the circuit breaker 10 and reducing airflow restrictions when the guard members 100,200 are mounted in front of high pressure exhaust vents (see, for example, exhaust vent 13, shown in FIG. 1) that are utilized during UL short circuit testing. More specifically, the coupling portions 112,114 are spaced from one another and each of the petal portions 120, 122, 124, 126 are spaced from one another, thereby providing suitable openings through which heat and exhaustive gases can pass. Accordingly, the petal portions 120, 122, 124, 126 are relatively close to one another to operate as barriers to potentially live electrical components, but are spaced from one another in order to allow for venting and heat dissipation.

It will thus be appreciated that the disclosed concept provides for an improved electrical system 2, and electrical switching apparatus 10 and guard member 100,200 therefor, in which operators are protected against inadvertent contact with potentially live electrical components of the electrical system 2, heat is able to be dissipated, and exhaustive gases are advantageously able to be reliably vented.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A guard member for an electrical switching apparatus of an electrical system, said electrical system comprising at least one electrical conductor, said electrical switching apparatus comprising a housing, said guard member comprising:

a base portion structured to receive said at least one electrical conductor;

a number of coupling portions extending from said base portion and being structured to be coupled to said housing; and a plurality of petal portions extending from said base portion away from said number of coupling portions, at least one of said plurality of petal portions being orientated at an acute angle with respect to said base portion, wherein each of said plurality of petal portions has an external surface extending from said base portion away from said number of coupling portions, said external surface substantially facing away from every portion of said guard member.

2. The guard member of claim 1 wherein said at least one of said plurality of petal portions comprises a first petal portion, a second petal portion, and a third petal portion each being spaced from one another.

3. The guard member of claim 2 wherein said plurality of petal portions further comprises a fourth petal portion orientated perpendicular with respect to said base portion.

4. The guard member of claim 1 wherein said number of coupling portions comprises a first coupling portion and a second coupling portion; wherein said base portion comprises a first end portion and a second end portion disposed opposite and distal the first end portion; wherein said plurality of petal portions are disposed between the first end portion and the second end portion; wherein the first coupling portion extends from the first end portion; and wherein the second coupling portion extends from the second end portion.

5. The guard member of claim 4 wherein said number of coupling portions further comprises a third coupling portion; wherein the first end portion comprises a first distal portion and a second distal portion disposed opposite and distal the first distal portion; wherein the first coupling portion extends from the first distal portion; and wherein the third coupling portion extends from the second distal portion.

6. The guard member of claim 5 wherein the first coupling portion and the third coupling portion each have hook portions disposed opposite and distal said base portion; and wherein each respective hook portion is structured to hook onto said housing.

7. The guard member of claim 5 wherein said first coupling portion, said second coupling portion, and said third coupling portion each extend from said base portion in a direction perpendicular to said base portion; and wherein said second coupling portion is planar.

8. A guard member for an electrical switching apparatus of an electrical system, said electrical system comprising at least one electrical conductor, said electrical switching apparatus comprising a housing, said guard member comprising:

a base portion structured to receive said at least one electrical conductor;

a number of coupling portions extending from said base portion and being structured to be coupled to said housing; and a plurality of petal portions extending from said base portion away from said number of coupling portions, at least one of said plurality of petal portions being orientated at an acute angle with respect to said base portion, wherein said at least one of said plurality of petal portions comprises a first petal portion, a second petal portion, and a third petal portion each being spaced from one another; wherein said plurality of petal portions further comprises a fourth petal portion orientated perpendicular with respect to said base portion; wherein said first petal portion is oriented at a first angle with respect to said base portion; wherein said second petal portion is oriented at a second angle with respect to said base portion; wherein said third petal portion is oriented at a third angle with respect to said base portion; wherein each of said second angle and said third angle is greater than said first angle; wherein said first petal portion is disposed opposite said fourth petal portion; and wherein said second petal portion is disposed opposite said third petal portion.

9. An electrical switching apparatus for an electrical system, said electrical system comprising at least one electrical conductor, said electrical switching apparatus comprising:

a housing; and at least one guard member comprising:

a base portion structured to receive said at least one electrical conductor, a number of coupling portions extending from said base portion and being coupled to said housing, and a plurality of petal portions extending from said base portion away from said number of coupling portions, at least one of said plurality of petal portions being orientated at an acute angle with respect to said base portion, wherein said housing comprises at least one shelf portion; wherein one of said number of coupling portions is coupled to said at least one shelf portion by a snap-fit mechanism; wherein said at least one shelf portion has an edge portion having a first planar portion, a second planar portion, and a protruding portion extending between the first planar portion and the second planar portion; wherein said one of said number of coupling portions comprises a hook portion; and wherein the protruding portion is disposed between the hook portion and said base portion.

10. The electrical switching apparatus of claim 9 wherein said at least one shelf portion is a first shelf portion and a second shelf portion; wherein a first one of said number of coupling portions is coupled to said first shelf portion by a snap-fit mechanism; and wherein a second one of said number of coupling portions is coupled to said second shelf portion by a snap-fit mechanism.

11. The electrical switching apparatus of claim 9 wherein said number of coupling portions comprises a first coupling portion and a second coupling portion; wherein said base portion comprises a first end portion and a second end portion disposed opposite and distal the first end portion; wherein said plurality of petal portions are disposed between the first end portion and the second end portion; wherein the first coupling portion extends from the first end portion; and wherein the second coupling portion extends from the second end portion.

12. The electrical switching apparatus of claim 11 wherein said number of coupling portions further comprises a third coupling portion; wherein the first end portion comprises a first distal portion and a second distal portion disposed opposite and distal the first distal portion; wherein the first coupling portion extends from the first distal portion; and wherein the third coupling portion extends from the second distal portion.

13. The electrical switching apparatus of claim 9 wherein said electrical switching apparatus is a circuit breaker.

14. The electrical switching apparatus of claim 9 wherein said at least one of said plurality of petal portions comprises a first petal portion, a second petal portion, and a third petal portion each being spaced from one another.

15. The electrical switching apparatus of claim 14 wherein said plurality of petal portions further comprises a fourth petal portion orientated perpendicular with respect to said base portion.

16. The electrical switching apparatus of claim 15 wherein said first petal portion is oriented at a first angle with respect to said base portion; wherein said second petal portion is oriented at a second angle with respect to said base portion; wherein said third petal portion is oriented at a third angle with respect to said base portion; wherein each of said second angle and said third angle is greater than said first angle; wherein said first petal portion is disposed opposite said fourth petal portion; and wherein said second petal portion is disposed opposite said third petal portion.

17. An electrical system comprising:

at least one electrical conductor; and an electrical switching apparatus comprising:

a housing, and at least one guard member comprising:

a base portion receiving said at least one electrical conductor, a number of coupling portions extending from said base portion and being coupled to said housing, and a plurality of petal portions extending from said base portion away from said number of coupling portions, at least one of said plurality of petal portions being orientated at an acute angle with respect to said base portion, wherein said at least one of said plurality of petal portions comprises a first petal portion, a second petal portion, and a third petal portion each being spaced from one another; wherein said plurality of petal portions further comprises a fourth petal portion orientated perpendicular with respect to said base portion; wherein said first petal portion is oriented at a first angle with respect to said base portion; wherein said second petal portion is oriented at a second angle with respect to said base portion; wherein said third petal portion is oriented at a third angle with respect to said base portion; wherein each of said second angle and said third angle is greater than said first angle; wherein said first petal portion is disposed opposite said fourth petal portion; and wherein said second petal portion is disposed opposite said third petal portion.

18. The electrical system of claim 17 wherein said at least one electrical conductor is a plurality of electrical conductors; wherein said at least one guard member is a plurality of guard members; and wherein said electrical switching apparatus is a multi-pole circuit breaker.

* * * * *